US006861109B2

(12) United States Patent
Takahashi et al.

(10) Patent No.: US 6,861,109 B2
(45) Date of Patent: Mar. 1, 2005

(54) RECORDING MATERIAL FOR BACK-PRINTING

(75) Inventors: Hideaki Takahashi, Kanuma (JP); Jun Takahashi, Kanuma (JP); Akio Ito, Kanuma (JP); Yukiko Murasawa, Kanuma (JP)

(73) Assignee: Sony Chemicals Corp., Tokyo (JP)

( * ) Notice: Subject to any disclaimer, the term of this patent is extended or adjusted under 35 U.S.C. 154(b) by 63 days.

(21) Appl. No.: 10/345,237

(22) Filed: Jan. 16, 2003

(65) Prior Publication Data

US 2003/0157278 A1 Aug. 21, 2003

(30) Foreign Application Priority Data

Feb. 13, 2002 (JP) ..... 2002-035077

(51) Int. Cl.[7] ..... B41M 5/40

(52) U.S. Cl. ..... 428/32.13; 428/32.26; 428/32.28; 428/32.31; 428/32.34; 427/243

(58) Field of Search ..... 428/32.13, 32.26, 428/32.28, 32.31, 32.34; 427/243; 156/277

(56) References Cited

U.S. PATENT DOCUMENTS 5,027,131 A * 6/1991 Hasegawa et al. ..... 347/105
5,059,983 A * 10/1991 Higuma et al. ..... 428/32.24
6,139,940 A * 10/2000 Iwamoto et al. ..... 428/32.34
6,521,327 B1 * 2/2003 Franke ..... 428/201
6,531,021 B1 * 3/2003 Loncar et al. ..... 156/247
6,616,992 B2 * 9/2003 Ito et al. ..... 428/32.25
6,649,232 B2 * 11/2003 Ito et al. ..... 428/32.13
6,777,038 B2 * 8/2004 Murasawa et al. ..... 428/32.15
2001/0006720 A1 * 7/2001 Takahashi et al. ..... 428/195
2002/0048658 A1 * 4/2002 Takahashi et al. ..... 428/195
2003/0127181 A1 * 7/2003 Kreckel et al. ..... 156/247
2003/0157278 A1 * 8/2003 Takahashi et al. ..... 428/32.13

* cited by examiner

*Primary Examiner*—B. Shewareged
(74) *Attorney, Agent, or Firm*—Oliff & Berridge, PLC

(57) ABSTRACT

A recording material for back-printing contains (i) a back-printing sheet comprising a transparent substrate, an ink-absorbing layer that is provided on the transparent substrate, and a porous ink-receiving layer that is provided on the ink-absorbing layer and has filler dispersed in a binder resin, and (ii) a back-printing sheet cover film having a cover substrate, and an adhesive layer that has an adhesive resin and is formed on the cover substrate, the refractive index of the filler and the refractive index of the adhesive resin are different to one another. Specifically, the difference between the refractive index of the filler and the refractive index of the adhesive resin is at least 1.0.

24 Claims, 1 Drawing Sheet

RECORDING MATERIAL FOR BACK-PRINTING

BACKGROUND OF THE INVENTION

1. Field of Invention

The present invention relates to a recording material for back-printing that is suitable as an illuminated film for ink jet recording or the like.

2. Description of Related Art

As shown in FIG. 2, a back-printing sheet 20 generally has a layered structure in which a transparent substrate 21 of PET or the like, an ink-absorbing layer 22, and a porous white ink-receiving layer 23 that has filler, i.e., a light-diffusing substance, dispersed in a binder resin are built up in this order. Here, the ink-absorbing layer 22 has better ink holding ability than the ink-receiving layer 23. Moreover, with such a back-printing sheet 20, an ink image is formed using an ink jet printer or the like on the surface of the ink-receiving layer 23, and this ink image permeates through the ink-receiving layer 23 and is held by the ink-absorbing layer 22. The ink image held by the ink-absorbing layer 22 is viewed from the transparent substrate 21 side.

An example of a usage of such a back-printing sheet 20 is a usage as an illuminated film. In this usage, light from a light source (backlight) positioned behind (i.e. on the ink-receiving layer side of) the back-printing sheet, which has had an ink image formed thereon, is irradiated onto the back-printing sheet, and the ink image is viewed from the transparent substrate 21 side.

Recently it has become common to put up illuminated films outdoors, and hence the ink-receiving layer 23 on which the ink image is formed in the back-printing sheet 20 is required to have better water resistance, gas degradation resistance, light resistance and so on than that previously required. A cover film, in which an adhesive layer comprising an acrylic adhesive resin or the like is formed on a polyester substrate, may thus be stuck onto the ink-receiving layer 23 on which the ink image has been formed.

However, in the case that a back-printing sheet on which an ink image has been formed has been put up outdoors as an illuminated film for a prolonged time, even though a cover film has been stuck onto the ink-receiving layer, there has still been a problem that the level of light diffusion at filler surfaces drops, and hence the ink-receiving layer 23 becomes transparent.

SUMMARY OF THE INVENTION

It is an object of the present invention to resolve the problem of the prior art described above, specifically to make it such that even in the case that a back-printing sheet on which an ink image has been formed is put up outdoors as an illuminated film for a prolonged time, dropping of the level of light diffusion at filler surfaces is prevented, and hence the ink-receiving layer does not become transparent.

The present inventors found that a cause of the level of light diffusion at filler surfaces dropping and hence the ink-receiving layer becoming transparent in the case that a back-printing sheet on which an ink image has been formed is put up outdoors as an illuminated film for a prolonged time, even though a cover film has been stuck onto the ink-receiving layer, is that the temperature of the back-printing sheet not only rises through heat discharged by the backlight light source but also further rises through irradiation with sunlight. Hence, the adhesive resin that constitutes the adhesive layer of the cover film softens, and thus fills into voids in the porous structure formed by the filler in the ink-absorbing layer, and moreover into pores in the filler itself. Based on this finding, the present inventors discovered that the above object can be attained by using filler having a refractive index that is substantially different to the refractive index of the adhesive resin, or by using filler that exhibits a specific surface area less than a certain specific surface area value, and thus achieved the present invention.

The present invention thus provides a recording material for back-printing comprising a back-printing sheet in which a porous ink-receiving layer having filler dispersed in a binder resin is formed on a transparent substrate, and a back-printing sheet cover film in which an adhesive layer composed of an adhesive resin is formed on a cover substrate, wherein the refractive index of the filler and the refractive index of the adhesive resin are different to one another.

DETAILED DESCRIPTION OF PREFERRED EMBODIMENTS

Following is a detailed description of embodiments of the present invention.

Figure 1A:
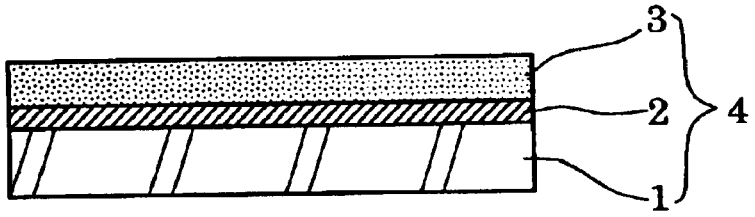
FIGS. 1A and 1B are sectional views of embodiments of a recording material for back-printing according to the present invention.
Figure 1B:
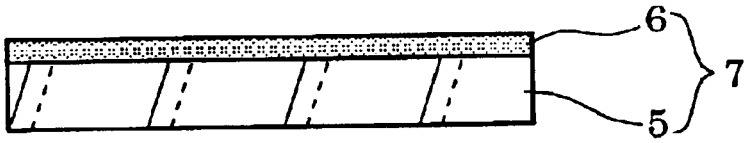
Figure 2:
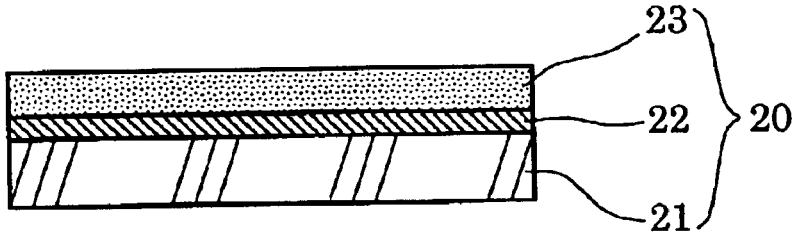
FIG. 2 is a sectional view of a conventional back-printing sheet.

As shown in FIGS. 1A and 1B, embodiments of the recording material for back-printing of the present invention comprise a back-printing sheet 4 in which a transparent substrate 1, an ink-absorbing layer 2 and an ink-receiving layer 3 are built up in this order (FIG. 1A), and a back-printing sheet cover film 7 in which an adhesive layer 6 comprising an adhesive resin is formed on a cover substrate 5 (FIG. 1B). In embodiments, the ink-absorbing layer 2 can be omitted in the case that the ink-receiving layer 3 is thick enough to be able to sufficiently hold ink. The cover film 7 is stuck to the back-printing sheet 4 from the adhesive layer 6 side to protect the formed image after ink jet recording or the like has been carried out on the back-printing sheet 4 from the ink-receiving layer 3 side.

In embodiments of the present invention, the ink-receiving layer 3 is a porous layer having filler dispersed in a binder resin, and is a layer that receives ink jet ink and thus holds and forms an image; however, in the case that the ink-receiving layer 3 is thin, if an ink-absorbing layer 2 is used together with the ink-receiving layer 3, then the ink-receiving layer 3 functions as a layer through which the ink permeates into the ink-absorbing layer 2.

In embodiments of the present invention, filler used in the ink-receiving layer 3 is filler having a refractive index that is different from the refractive index of the adhesive resin that constitutes the adhesive layer 6 of the cover film 7.

In embodiments, either the refractive index of the filler or the refractive index of the adhesive resin may be the higher of the two, but in general it is preferable for the refractive index of the filler to be the higher, since then the scope of material selection is broader.

The extent of the difference between the refractive index of the filler and the refractive index of the adhesive resin is such that the ink-receiving layer 3 does not become transparent through the adhesive resin permeating into the ink-receiving layer 3. Preferably, the difference between the refractive index of the filler and the refractive index of the adhesive resin is at least 1.0.

It is preferable for such filler, exhibiting a refractive index that is different to the refractive index of the adhesive resin by at least 1.0, to be contained in an amount of at least 20 vol % of all the filler contained in the ink-receiving layer 3. In the case that this percentage is too low, there will be a risk of the effect of preventing the ink-receiving layer 3 from becoming transparent being insufficient.

In the case that the difference between the refractive index of the filler and the refractive index of the adhesive resin is small (e.g., less than 0.1), the effect of preventing the ink-receiving layer 3 from becoming transparent can be secured by using filler having a specific surface area of not more than 3 $m^2/g$. In this case, it is preferable for such filler to be contained in an amount of at least 40 vol % of all of the filler contained in the ink-receiving layer 3. In the case that this percentage is too low, there will be a risk of the effect of preventing the ink-receiving layer 3 from becoming transparent being insufficient.

In embodiments of the present invention, specific examples of filler in the ink-receiving layer 3 include silica (refractive index 1.5), titanium dioxide (refractive index 2.5), alumina (refractive index 1.7), zinc oxide (refractive index 2.0), calcium carbonate (refractive index 1.5), and a benzoguanamine resin (refractive index 1.57).

Moreover, examples of the binder resin in the ink-receiving layer 3 include a polyester resin, a phenoxy resin, a polyvinyl alcohol resin, a polyvinyl butyral resin, polyvinyl acetate, a styrene-butadiene rubber, an acrylic resin, an acrylic emulsion, a polyamide resin, an epoxy resin, a polyvinyl acetal, polyethylene, polypropylene, an ionomer, and a urethane resin or the like. Of these, it is preferable to use a polyvinyl butyral resin, since the ink absorbability is low, the coating film strength is high, the flexibility is high, and the coatability is excellent.

Regarding the mixing proportions of filler and the binder resin in the ink-receiving layer 3, considering the ink receiving ability and the preferable for there to be 5 to 200 parts by weight of the binder resin per 100 parts by weight of filler.

In embodiments of the present invention, it is preferable to crosslink the ink-receiving layer 3 itself to improve the water resistance of the ink-receiving layer 3. Such a crosslinking method can be selected as appropriate in accordance with the type of binder resin, the type of filler, the type of resin used in the ink-absorbing layer 2 (described below) and so on. For example, in the case that a polyvinyl acetal, a phenoxy resin or a polyester resin having active hydrogens or the like is used as the binder resin, an isocyanate type or melamine type crosslinking agent can be used. Of these, an isocyanate type crosslinking agent is preferable, since the crosslinking reaction is stable. Moreover, in the case that a vinyl type resin or the like is used as the binder resin, the crosslinking may be carried out by irradiating with an electron beam. Other possible crosslinking methods include irradiating with ultraviolet rays.

Regarding the extent of crosslinking, it is preferable to make the amount of the crosslinking agent less than an equivalent to the amount of the ink-absorbing layer 2, from the standpoint of preventing the ink absorbing ability of the ink-absorbing layer 2 from dropping.

Various additives such as whiteners, surfactants, pigments, ultraviolet absorbers, antioxidants and pH regulators may be included in the ink-receiving layer 3.

There are no particular limitations on the thickness of the ink-receiving layer 3, but in embodiments this thickness is generally 5 to 30 $\mu$m.

With the present invention, in the case that the ink-receiving layer 3 is relatively thin, it may not be possible to hold the ink with only the ink-receiving layer 3. In such a case, it is preferable to provide an ink-absorbing layer 2 that has a better ink holding ability than the ink-receiving layer 3 between the ink-receiving layer 3 and the transparent substrate 1.

In embodiments, the ink-absorbing layer 2 is formed from a resin that is capable of absorbing ink. Ink for back-printing is generally hydrophilic, and hence it is generally preferable for the ink-absorbing layer 2 to be formed from a hydrophilic resin, for example a water-soluble polyester resin, a polyvinyl pyrrolidone resin, a polyvinyl alcohol resin, a polyurethane resin, a polyvinyl acetal resin, an ethylene-vinyl acetate copolymer, or an acrylic resin or the like.

Moreover, various additives such as whiteners, surfactants, pigments, ultraviolet absorbers, antioxidants and pH regulators or the like may be included in the ink-absorbing layer 2.

It is preferable for the ink-absorbing layer 2 to be crosslinked in at least a region thereof on the ink-receiving layer side. As a result, swelling of the ink-absorbing layer 2 when ink has passed through the ink-receiving layer 3 and permeated into the ink-absorbing layer 2 can be suppressed, and hence movement of the ink from the ink-absorbing layer 2 into voids in the porous structure of the ink-receiving layer 3 can be suppressed.

As a method of crosslinking the ink-absorbing layer 2 in at least a region thereof on the ink-receiving layer side, from the standpoint of simplifying the manufacturing process, it is preferable to use the same cross-linking agent, electron beam or the like in the formation of the ink-absorbing layer 2 as is used in the formation of the ink-receiving layer 3. In embodiments, when crosslinking the ink-absorbing layer 2, a coating solution for ink-absorbing layer 2 formation that does not contain the crosslinking agent is applied onto the transparent substrate and dried to form an ink-absorbing layer coating film, and then a coating solution for ink-receiving layer 3 formation that contains the crosslinking agent is applied thereon and left for a prescribed time until the crosslinking is completely finished. In this case, the crosslinking agent and the material from which the ink-absorbing layer 2 is formed are selected as appropriate such that the crosslinking agent which is added to crosslink the ink-receiving layer 3 also crosslinks the ink-absorbing layer 2.

If the extent of crosslinking of the ink-absorbing layer 2 is too high, then the ink absorbing ability will drop. As discussed above, it is therefore preferable to make the amount of the crosslinking agent used for crosslinking the ink-receiving layer 3 less than an equivalent to the amount of the crosslinking agent used for crosslinking the ink-absorbing layer 2.

There are no particular limitations on the thickness of the ink-absorbing layer 2, but in embodiments this thickness is generally 5 to 30 $\mu$m.

The transparent substrate 1. that constitutes the back-printing sheet 4 can be, for example, a transparent film of a polyester, polyethylene, polypropylene, a polyamide, vinyl chloride, a polycarbonate or the like. There are no particular limitations on the thickness of the transparent substrate 1, but in embodiments this thickness is generally 10 to 500 $\mu$m.

In embodiments, the cover substrate 5 that constitutes the cover film and the adhesive resin that constitutes the adhesive layer 6 of the cover film can be those used in conventional back-printing cover film. For example, a polyester substrate, an acrylic substrate, a polyamide substrate or the like can be used as the cover substrate 5. Moreover, an acrylic adhesive resin (refractive index 1.5) or the like can be used as the adhesive resin.

The recording material for back-printing of the present invention can be used with various image recording methods. For example, image formation can be carried out using an ink jet printer or the like, or may be carried out using a fountain pen, felt-tipped pens, a pen plotter or the like. Specifically, after ink jet recording or the like has been carried out on the back-printing sheet from the ink-receiving layer side, the cover film should be stuck onto the back-printing sheet from the adhesive layer side so as to protect the image that has been formed.

In this way, a back-printed article is obtained in which, after printing image information on the ink-receiving layer of a back-printing sheet according to embodiments (e.g., a porous ink-receiving layer comprising filler dispersed in a binder resin formed on a transparent substrate), a back-printing sheet cover film according to embodiments (e.g., an adhesive layer comprising an adhesive resin formed on a cover substrate) is stuck onto the ink-receiving layer of the back-printing sheet from the adhesive layer side of the back-printing sheet cover film. The ink-receiving layer can be suppressed from becoming transparent in such a back-printed article because the refractive index of the filler and the refractive index of the adhesive resin are different to one another.

EXAMPLES

The present invention will now be described more specifically through examples.

Examples 1 to 4 and Comparative Example 1

(Manufacture of Back-printing Sheet)

First, a coating liquid for ink-absorbing layer formation was prepared by mixing the components listed in Table 1 together for 3 hours using a jar mill. This coating liquid was then applied onto a 100 μm-thick transparent polyester film (HS-74, made by Teijin DuPont Films) using a bar coater such that the dried thickness would be approximately 13 μm. Drying was then carried out in a hot air circulating type furnace at 120° C. for 5 minutes, thus forming an ink-absorbing layer.

TABLE 1

| Component | Parts by wt |
|---|---|
| Polyurethane emulsion (HS-310X, made by Takamatsu Oil and Fat Co., Ltd.) | 71.43 |
| Polyurethane emulsion (Patelacol IJ-60, made by Dainippon Ink and Chemicals, Inc.) | 16.12 |
| Aluminum hydroxide (HIGILITE H42, made by Showa Denko K.K.) | 2.5 |
| Ion-exchange water | 9.95 |

Next, the components listed in Table 2 were mixed together in a dissolver, thus dissolving the resin. 40 parts per weight of glass beads were then put in per 100 parts per weight of all of the components listed in Table 2, and dispersion was carried out for 12 hours using a jar mill, thus obtaining This coating solution was then applied onto the above-mentioned ink-absorbing layer using a coil bar such that the dried thickness would be approximately 13 μm. After formation of the coating film, the article was left for approximately 3 days, thus obtaining a back-printing sheet.

TABLE 2

| Component | Parts by wt |
|---|---|
| Polyvinyl butyral (Denka Butyral #6000EP, made by Denki Kagaku Kogyo K.K.) | 6.0 |
| Filler | 18.0 |
| Example 1 Silica*1/titanium dioxide*2 = 90/10 (Vol %) | |
| Example 2 Silica*1/titanium dioxide*2 = 80/20 (Vol %) | |
| Example 3 Silica*1/organic resin*3 = 80/20 (Vol %) | |
| Example 4 Silica*1/organic resin*3 = 60/40 (Vol %) | |
| Comparative Example 1 Silica*1 only | |
| Isocyanate (Takenate D-110N, made by Takeda Chemical Industries) | 0.5 |
| MEK | 37.35 |
| Cyclohexanone | 37.35 |

*1Mizukasil P527, made by Mizusawa Industrial Chemicals, Ltd.; refractive index ≈ 1.5; specific surface area = 45 $m^2/g$
*2Tipaque CR-58, made by Ishihara Sangyo Kaisha, Ltd.; refractive index = 2.5; specific surface area = 16 $m^2/g$
*3Benzoguanamine resin particles, made by Nippon Shokubai Co., Ltd.; refractive index = 1.57; specific surface area = 3 $m^2/g$ Separate to the back-printing sheet obtained, a commercially sold laminate film (LAG Protect G-055AV50, made by Lintec Corporation), in which an acrylic adhesive layer of refractive index approximately 1.5 is formed on one surface of a 50 μm-thick polyester film, was prepared as a back-printing cover film.

This back-printing cover film and the back-printing sheet obtained above were combined to form a single set, thus manufacturing a recording material for back-printing of the present invention.

(Evaluation)

Character information was recorded using an ink jet printer (Maxart MC-7000, made by Seiko Epson Corporation) onto the ink-receiving layer of the back-printing sheet of the recording material for back-printing of each of the Examples and Comparative Examples. The cover film was then stuck onto the recorded surface using a cold laminator at a speed of 1 m/min.

The extent of the ink-receiving layer's resistance to becoming transparent was tested and evaluated as described below for each of the recorded articles obtained. The results obtained are shown in Table 3. (Evaluation of resistance to becoming transparent)

The light transmission density was measured for each of the recorded articles obtained after storing for one week at 20° C., 30° C. or 40° C., with the transmission density of an unprinted part immediately after sticking on the cover film being taken as 100. In the case that the percentage drop in the transmission density was less than 100, it was judged that the ink-receiving layer substantially did not did not become transparent, and 'A' was recorded in Table 3. In the case that the percentage drop in the transmission density was at least 10% but less than 200, it was judged that the ink-receiving layer became slightly transparent, and 'B' was recorded in Table 3. In the case that the percentage drop in the transmission density was 200 or more, it was judged that the ink-receiving layer became transparent, and 'C' was recorded in Table 3.

TABLE 3

| Filler used | Amount added (vol %) | Refractive index | Specific surface area ($m^2/g$) | Resistance to becoming transparent (after leaving for 1 week) 20° C. | 30° C. | 40° C. |
|---|---|---|---|---|---|---|
| Ex. 1 Silica/titanium dioxide | 90/10 | 1.5/2.5 | 45/15 | A | A | B |
| Ex. 2 Silica/titanium dioxide | 80/20 | 1.5/2.5 | 45/15 | A | A | A |
| Ex. 3 Silica/benzoguanamine | 80/20 | 1.5/1.57 | 45/3 | A | A | B |
| Ex. 4 Silica/benzoguanamine | 60/40 | 1.5/1.57 | 45/3 | A | A | A |
| Comp. Ex. 1 Silica only | 100/— | 1.5/— | 45/— | B | B | C |

From Table 3, it can be seen that, with the adhesive resin in the adhesive layer of the cover film having a refractive index of approximately 1.5, in the cases of Examples 1 to 4 in which filler having a refractive index of 1.57 or 2.5 was used in the ink-receiving layer, the ink-rreciving layer had not become transparent after storing for one week at 20° C. or 30° C. In contrast, it can be seen that in the case of Comparative Example 1 in which filler having a refractive index of approximately 1.5 was used, the ink-receiving layer had started to become transparent after storing for one week at 20° C.

From the results for Examples 1 and 2, it can be seen that in the case that filler having a refractive index different to the refractive index of the adhesive resin by 1.0 is used, if this filler is contained in an amount of 20 vol % in all of the filler, then it is possible to sufficiently prevent the ink-receiving layer from becoming transparent even after storing for one week at 40° C.

Moreover, from the results for Examples 3 and 4, it can be seen that in the case that filler having a refractive index different to the refractive index of the adhesive resin by only 0.07 is used, if this filler is one having a specific surface area of 3 $m^2/g$, then good results are obtained. In particular, it can be seen that if this filler is contained in an amount of 40 vol % in all the filler, then it is possible to sufficiently prevent the ink-receiving layer from becoming transparent even after storing for one week at 40° C.

According to the present invention, even in the case that a back-printing sheet on which an ink image has been formed is put up outdoors as an illuminated film for a prolonged time, dropping of the level of light diffusion at filler surfaces is prevented and hence the ink-receiving layer does not become transparent.

What is claimed is:

1. A back-printing recording material, comprising:

a transparent substrate, a porous ink-receiving layer havina an ink image formed thereon, said porous ink-receiving layer comprising a filler dispersed in a binder resin and a cover film comprising an adhesive layer comprising an adhesive resin formed on a cover substrate, wherein a refractive index of said filler is different from a refractive index of said adhesive resin.

2. The back-printing recording material according to claim 1, comprising an ink-absorbing layer that has a better ink-holding-ability than said porous ink-receiving layer.

3. The back-printing recording material according to claim 1, wherein said refractive index of said filler is higher than said refractive index of said adhesive resin.

4. The back-printing recording material according to claim 1, wherein said refractive index of said filler is lower than said refractive index of said adhesive resin.

5. The back-printing recording material according to claim 1, wherein said refractive index of said filler is different from said refractive index of said adhesive resin by at least about 1.0.

6. The back-printing recording material according to claim 5, wherein the filler is contained in an amount of at least 20 vol % of all filler contained in said porous ink-receiving layer.

7. The back-printing recording material according to claim 1, wherein said filler has a refractive index from about 1.0 to about 2.5.

8. The back-printing recording material according to claim 7, wherein said refractive index is selected from the group consisting of 1.0, 1.5, 1.57, 1.7, 2.0 and 2.5.

9. The back-printing recording material according to claim 1, wherein said filler has a specific surface area not more than 3$m^2/g$.

10. The back-printing recording material according to claim 9, wherein the filler is contained in an amount of at least 40 vol % of all filler contained in said porous ink-receiving layer.

11. The back-printing recording material according to claim 1, wherein said filler is at least one member selected from the group consisting of silica, titanium dioxide, zinc oxide, calcium carbonate and beuzoguanamine resin.

12. The back-printing recording material according to claim 1, wherein said binder resin is at least one member selected from the group consisting of polyester resin, phenoxy resin, polyvinyl alcohol resin, polyvinyl butyral resin, polyvinyl acetate, styrene-butadiene rubber, acrylic resin, acrylic emulsion, polyamide resin, epoxy resin, polyvinyl acetal, polyethylene, polypropylene, ionomer and urethane resin.

13. The back-printing recording material according to claim 12, wherein said binder resin is polyvinyl butyral resin.

14. The back-printing recording material according to claim 1, wherein said binder resin is present in an amount of about 5 to about 200 parts by weight per 100 parts by weight of said filler.

15. The back-printing recording material according to claim 1, further comprising an ink-absorbing layer; wherein at least one of said porous ink-receiving layer and said ink-absorbing layer is cross-linked.

16. The back-printing recording material according to claim 15, wherein at least one of said porous ink-receiving layer and said ink-absorbing layer is cross-linked by at least one cross-linking agent selected from the group consisting of an isocyanate type cross-linking agent and a melamine type cross-linking agent.

17. The back-printing recording material according to claim 16, wherein said porous ink-receiving layer and said ink-absorbing layer are cross-linked by the same cross-linking agent.

18. The back-printing recording material according to claim 15, wherein at least one of said porous ink-receiving layer and said ink-absorbing layer is cross-linked by irradiation with at least one member selected from the group consisting of an electron beam and ultraviolet rays.

19. The back-printing recording material according to claim 1, wherein said porous ink-receiving layer has a thickness of about 5 to about 30 $\mu$m.

20. A method for making a back-printing recording material, comprising:

forming a porous ink-receiving layer comprising a filler dispersed in a binder resin, over a transparent substrate, optionally cross-linking said porous ink-receiving layer and forming a cover film, comprising an adhesive layer comprising an adhesive resin formed on a cover substrate, over said porous ink-receiving layer, wherein said ink-receivina layer has an ink imaae formed thereon; and wherein said filler has a different refractive index from said adhesive resin.

21. The method according to claim 20, comprising:

forming an ink-absorbing layer over said transparent substrate, forming said porous ink-receiving layer over said ink-absorbing layer and optionally cross-linking said ink-absorbing layer.

22. A method of making an ink image on a back-printing material, comprising:

forming the ink image on a surface of a porous ink-receiving layer of said back-printing material, optionally cross-linking said porous ink-receiving layer, forming a cover film, comprising an adhesive layer comprising an adhesive resin fanned on a cover substrate, over said porous ink-receiving layer, permeating said ink image through said porous ink-receiving layer of said back-printing material and optionally holding said ink image to an ink-absorbing layer, wherein said porous ink-receiving layer comprises a filler dispersed in a binder resin, wherein said porous ink-receivina layer is formed over a transparent substrate, and wherein said filler has a different refractive index from said adhesive resin.

23. The method according to claim 22, wherein said ink image is formed using at least one member selected from the group consisting of an ink jet printer, a fountain pen, a felt-tipped pen and a pen plotter.

24. The method according to claim 22, comprising holding said ink image to an ink-absorbing layer and optionally cross-linking said ink-absorbing layer.

* * * * *